US006729707B2

(12) United States Patent
Corrigan

(10) Patent No.: US 6,729,707 B2
(45) Date of Patent: May 4, 2004

(54) SELF-CALIBRATION OF POWER DELIVERY CONTROL TO FIRING RESISTORS

(75) Inventor: George H. Corrigan, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/135,736

(22) Filed: Apr. 30, 2002

(65) Prior Publication Data

US 2003/0202024 A1 Oct. 30, 2003

(51) Int. Cl.[7] ..... B41J 29/38
(52) U.S. Cl. ..... 347/9; 347/12; 347/211
(58) Field of Search ..... 347/9, 211, 247, 347/237, 12

(56) References Cited

U.S. PATENT DOCUMENTS

| | | | | |
|---|---|---|---|---|
| 4,463,359 A | | 7/1984 | Ayata et al. | 346/1.1 |
| 4,595,935 A | * | 6/1986 | Brooks et al. | 346/76 |
| 4,695,853 A | | 9/1987 | Hackleman et al. | 346/140 R |
| 4,695,854 A | | 9/1987 | Cruz-Uribe | 346/140 R |
| 4,719,477 A | | 1/1988 | Hess | 346/140 R |
| 4,737,800 A | * | 4/1988 | Caillol et al. | 347/211 |
| 4,764,659 A | | 8/1988 | Minami et al. | 219/216 |
| 4,897,668 A | * | 1/1990 | Nagato et al. | 346/76 |
| 4,982,199 A | | 1/1991 | Dunn | 346/1.1 |
| 4,999,650 A | | 3/1991 | Braun | 346/140 R |
| 5,016,023 A | | 5/1991 | Chan et al. | 346/1.1 |
| 5,030,971 A | | 7/1991 | Drake et al. | 346/140 R |
| 5,049,898 A | | 9/1991 | Arthur et al. | 346/1.1 |
| 5,053,790 A | * | 10/1991 | Stephenson et al. | 346/76 |
| 5,103,246 A | | 4/1992 | Dunn | 346/140 R |
| 5,327,165 A | | 7/1994 | Elliott | 346/76 PH |
| 5,357,081 A | * | 10/1994 | Borhorquez | 219/497 |
| 5,363,134 A | | 11/1994 | Barbehenn et al. | 347/49 |

(List continued on next page.)

FOREIGN PATENT DOCUMENTS

| | | | |
|---|---|---|---|
| EP | 0499373 A2 | 8/1992 | |
| EP | 0547921 A2 | 6/1993 | B41J/2/175 |
| EP | 1004442 A2 | 5/2000 | |
| EP | 1029685 A2 | 8/2000 | |

OTHER PUBLICATIONS

A copy of European Search Report for Application No. EP 02 25 1655 mailed on May 22, 2003 (3 pages).

*Primary Examiner*—Stephen D. Meier
*Assistant Examiner*—Lam Nguyen

(57) ABSTRACT

A fluid ejection device having an internal power supply path and a power regulator providing an offset voltage from the internal power supply path voltage. A self-calibration circuit in the inkjet printhead determines a regulation band of the power regulator defined by a lower set point offset voltage and an upper set point offset voltage. The inkjet printhead includes a group of nozzles, a corresponding group of firing resistors, and a corresponding group of switches controllable to couple a selected firing resistor of the group of firing resistors between the internal power supply path and the offset voltage to thereby permit electrical currant to pass through the selected firing resistor to cause a corresponding selected nozzle to fire.

19 Claims, 8 Drawing Sheets

U.S. PATENT DOCUMENTS 5,365,312 A 11/1994 Hillmann et al. ..... 355/206
5,371,530 A 12/1994 Hawkins et al. ..... 347/9
5,541,629 A * 7/1996 Saunders et al. ..... 347/12
5,604,513 A 2/1997 Takahashi et al. ..... 345/153
5,610,635 A 3/1997 Murray et al. ..... 347/7
5,633,671 A * 5/1997 Watanabe ..... 347/192
5,646,660 A 7/1997 Murray ..... 347/59
5,648,804 A 7/1997 Keefe et al. ..... 347/47
5,668,579 A * 9/1997 Fujii et al. ..... 347/10
5,815,172 A 9/1998 Moh ..... 347/14
5,815,180 A 9/1998 Barbour et al. ..... 347/59
5,886,718 A 3/1999 Johnson et al. ..... 347/85
5,912,684 A * 6/1999 Fujii et al. ..... 347/54
5,923,825 A * 7/1999 Orilicki et al. ..... 395/111
5,946,012 A 8/1999 Courian et al. ..... 347/63
5,997,124 A 12/1999 Capps et al.
6,091,891 A 7/2000 Overall et al. ..... 395/112
6,109,716 A 8/2000 Takahashi ..... 347/11
6,126,261 A 10/2000 Yamanaka ..... 347/12
6,145,961 A * 11/2000 Otsuki ..... 347/43
6,178,009 B1 1/2001 Yamada et al. ..... 358/1.9
6,183,056 B1 * 2/2001 Corrigan et al. ..... 347/14
6,193,345 B1 2/2001 Feinn et al. ..... 347/12
6,199,969 B1 3/2001 Haflinger et al.
6,208,127 B1 * 3/2001 Doluca ..... 323/349
6,290,333 B1 * 9/2001 Wade et al. ..... 347/50
6,346,899 B1 2/2002 Hadidi

* cited by examiner

SELF-CALIBRATION OF POWER DELIVERY CONTROL TO FIRING RESISTORS

CROSS-REFERENCE TO RELATED APPLICATIONS

This Non-Provisional Patent Application is related to the following commonly assigned U.S. patent applications: Ser. No. 09/253,411, filed on Feb. 19, 1999, entitled "HIGH PERFORMANCE PRINTING SYSTEM AND PROTOCOL," with Ser. No. 09/808,763, filed on Mar. 15, 2001, entitled "INTEGRATED CONTROL OF POWER DELIVERY TO FIRING RESISTORS FOR INKJET PRINTHEAD ASSEMBLY," all of which are herein incorporated by reference.

THE FIELD OF THE INVENTION

The present invention relates generally to fluid ejection devices, and more particularly to self-calibration of power delivery control to firing resistors in fluid ejection devices.

BACKGROUND OF THE INVENTION

One type of conventional fluid ejection system is a conventional inkjet printing system which includes a printhead, an ink supply which supplies liquid ink to the printhead, and an electronic controller which controls the printhead. The printhead ejects ink drops through a plurality of orifices or nozzles and toward a print medium, such as a sheet of paper, so as to print onto the print medium. Typically, the orifices are arranged in one or more arrays such that properly sequenced ejection of ink from the orifices causes characters or other images to be printed upon the print medium as the printhead and the print medium are moved relative to each other.

Typically, the printhead ejects the ink drops through the nozzles by rapidly heating a small volume of ink located in vaporization chambers with small electric heaters, such as thin film resistors. Heating the ink causes the ink to vaporize and be ejected from the nozzles. Typically, for one dot of ink, a remote printhead controller typically located as part of the processing electronics of a printer, controls activation of an electrical current from a power supply external to the printhead. The electrical current is passed through a selected thin film resistor to heat the ink in a corresponding selected vaporization chamber. The thin film resistors are herein referred to as firing resistors.

Typically, a high-current load on the power supply supplying the electrical current to the firing resistors occurs if a large number of firing resistors are simultaneously energized on a single printhead die. The resulting high electrical current flowing through parasitic resistances in conductors to the printhead die causes the voltage at the printhead die to sag. Less energy is delivered to the firing resistors as a result of this voltage sag at the printhead die.

In one conventional inkjet printing system, large by-pass capacitors are disposed adjacent to the printhead to alleviate a portion of this voltage sag. Nevertheless, any resistance between the large by-pass capacitors and the printhead is not compensated for in this conventional inkjet printing system. Furthermore, a DC sag on the power supply supplying the electrical current to the firing resistors under continuous load is also not compensated for in this conventional inkjet printing system.

In one conventional inkjet printing system, the duration of the power being supplied to the firing resistors is modulated in response to a change in the power supply voltage at the printhead. In this conventional inkjet printing system, constant energy is delivered to each firing resistor. Nevertheless, firing resistors receive more instantaneous power when only a few firing resistors are energized. The life of a firing resistor can be increased by reducing the amount of instantaneous power delivered to the firing resistor. Therefore, there is a desire to have both a fixed power applied to the firing resistors and a fixed duration that the fixed power is applied to the firing resistors.

For reasons stated above and for other reasons presented in the Detailed Description section of the present specification, a fluid ejection device, such as an inkjet printhead, is desired which minimizes instantaneous power delivered to firing resistors to thereby increase the life of the fluid ejection device. In addition, there is a desire for a fluid ejection device which minimizes instantaneous power delivered to firing resistors and has a simplified calibration process where the calibration time of the fluid ejection device is not significantly increased by the instantaneous power delivery minimization technique.

SUMMARY OF THE INVENTION

One aspect of the present invention provides a fluid ejection device including an internal power supply path and a power regulator providing an offset voltage from the internal power supply path voltage. The power regulator includes a self-calibration circuit adapted to determine a regulation band of the power regulator defined by a lower set point offset voltage and an upper set point offset voltage. The fluid ejection device includes a group of nozzles, a corresponding group of firing resistors, and a corresponding group of switches. The switches are controllable to couple a selected firing resistor of the group of firing resistors between the internal power supply path and the offset voltage to thereby permit electrical current to pass through the selected firing resistor to cause a corresponding selected nozzle to fire.

DETAILED DESCRIPTION

In the following detailed description of the preferred embodiments, reference is made to the accompanying drawings which form a part hereof, and in which is shown by way of illustration specific embodiments in which the invention may be practiced. In this regard, directional terminology, such as "top," "bottom," "front," "back," "leading," "trailing," etc., is used with reference to the orientation of the Figure(s) being described. The inkjet printhead assembly and related components of the present invention can be positioned in a number of different orientations. As such, the directional terminology is used for purposes of illustration and is in no way limiting. It is to be understood that other embodiments may be utilized and structural or logical changes may be made without departing from the scope of the present invention. The following detailed description, therefore, is not to be taken in a limiting sense, and the scope of the present invention is defined by the appended claims.

Figure 1:
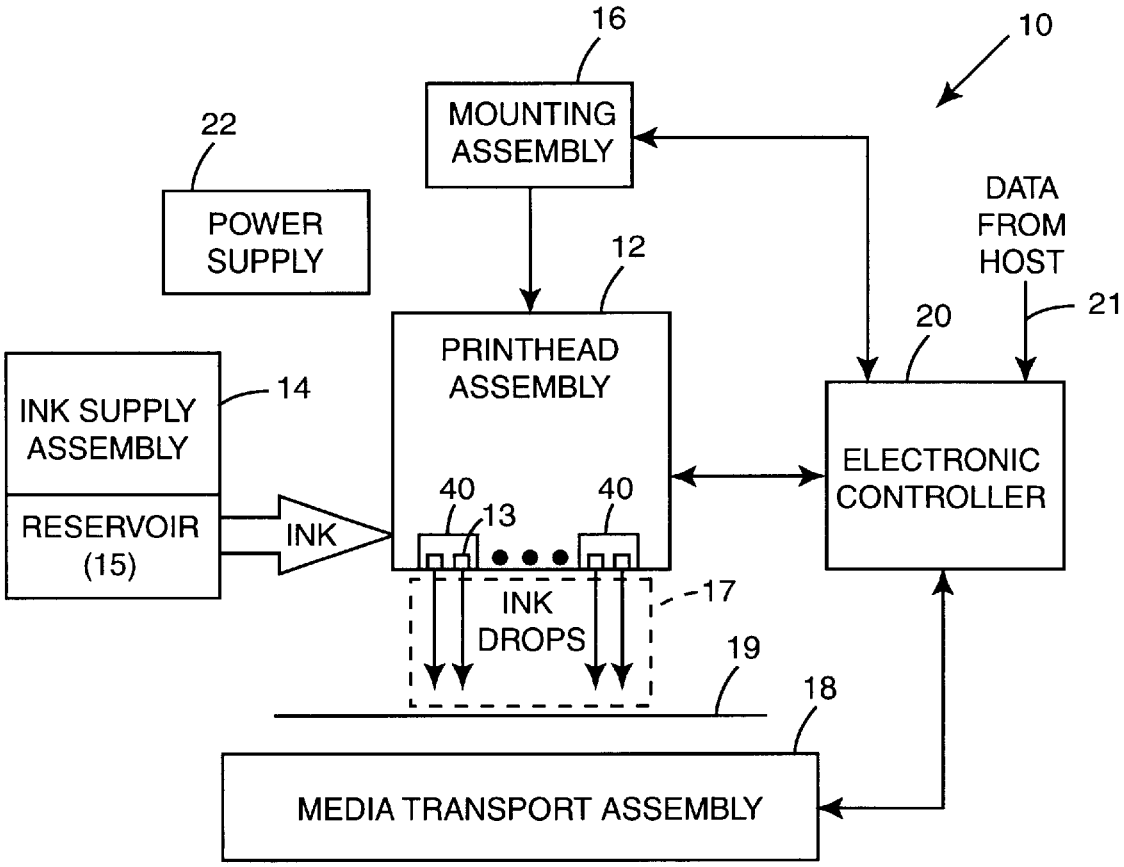
FIG. 1 is a block diagram illustrating one embodiment of an inkjet printing system.

FIG. 1 illustrates one embodiment of a fluid ejection system referred to as an inkjet printing system 10 which ejects ink. Other embodiments of fluid ejection systems include printing and non-printing systems, such as medical fluid delivery systems, which eject fluids including liquids, such as water, ink, blood, photoresist, or organic light-emitting materials, or flowable particles of a solid, such as talcum powder or a powered drug.

In one embodiment, the fluid ejection system includes a fluid ejection assembly, such as an inkjet printhead assembly 12; and a fluid supply assembly, such as an ink supply assembly 14. In the illustrated embodiment, inkjet printing system 10 also includes a mounting assembly 16, a media transport assembly 18, and an electronic controller 20. At least one power supply 22 provides power to the various electrical components of inkjet printing system 10. In one embodiment, the fluid ejection assembly includes at least one fluid ejection device, such as at least one printhead or printhead die 40. In the illustrated embodiment, each printhead 40 ejects drops of ink through a plurality of orifices or nozzles 13 and toward a print medium 19 so as to print onto print medium 19. Print medium 19 is any type of suitable sheet material, such as paper, card stock, transparencies, Mylar, and the like. Typically, nozzles 13 are arranged in one or more columns or arrays such that properly sequenced ejection of ink from nozzles 13 causes characters, symbols, and/or other graphics or images to be printed upon print medium 19 as inkjet printhead assembly 12 and print medium 19 are moved relative to each other.

Ink supply assembly 14 supplies ink to printhead assembly 12 and includes a reservoir 15 for storing ink. As such, ink flows from reservoir 15 to inkjet printhead assembly 12. Ink supply assembly 14 and inkjet printhead assembly 12 can form either a one-way ink delivery system or a recirculating ink delivery system. In a one-way ink delivery system, substantially all of the ink supplied to inkjet printhead assembly 12 is consumed during printing. In a recirculating ink delivery system, however, only a portion of the ink supplied to printhead assembly 12 is consumed during printing. As such, ink not consumed during printing is returned to ink supply assembly 14.

In one embodiment, inkjet printhead assembly 12 and ink supply assembly 14 are housed together in an inkjet cartridge or pen. In another embodiment, ink supply assembly 14 is separate from inkjet printhead assembly 12 and supplies ink to inkjet printhead assembly 12 through an interface connection, such as a supply tube. In either embodiment, reservoir 15 of ink supply assembly 14 may be removed, replaced, and/or refilled. In one embodiment, where inkjet printhead assembly 12 and ink supply assembly 14 are housed together in an inkjet cartridge, reservoir 15 includes a local reservoir located within the cartridge as well as a larger reservoir located separately from the cartridge. As such, the separate, larger reservoir serves to refill the local reservoir. Accordingly, the separate, larger reservoir and/or the local reservoir may be removed, replaced, and/or refilled.

Mounting assembly 16 positions inkjet printhead assembly 12 relative to media transport assembly 18 and media transport assembly 18 positions print medium 19 relative to inkjet printhead assembly 12. Thus, a print zone 17 is defined adjacent to nozzles 13 in an area between inkjet printhead assembly 12 and print medium 19. In one embodiment, inkjet printhead assembly 12 is a scanning type printhead assembly. As such, mounting assembly 16 includes a carriage for moving inkjet printhead assembly 12 relative to media transport assembly 18 to scan print medium 19. In another embodiment, inkjet printhead assembly 12 is a non-scanning type printhead assembly. As such, mounting assembly 16 fixes inkjet printhead assembly 12 at a prescribed position relative to media transport assembly 18. Thus, media transport assembly 18 positions print medium 19 relative to inkjet printhead assembly 12.

Electronic controller or printer controller 20 typically includes a processor, firmware, and other printer electronics for communicating with and controlling inkjet printhead assembly 12, mounting assembly 16, and media transport assembly 18. Electronic controller 20 receives data 21 from a host system, such as a computer, and includes memory for temporarily storing data 21. Typically, data 21 is sent to inkjet printing system 10 along an electronic, infrared, optical, or other information transfer path. Data 21 represents, for example, a document and/or file to be printed. As such, data 21 forms a print job for inkjet printing system 10 and includes one or more print job commands and/or command parameters.

In one embodiment, electronic controller 20 controls inkjet printhead assembly 12 for ejection of ink drops from nozzles 13. As such, electronic controller 20 defines a pattern of ejected ink drops which form characters, symbols, and/or other graphics or images on print medium 19. The pattern of ejected ink drops is determined by the print job commands and/or command parameters.

In one embodiment, inkjet printhead assembly 12 includes one printhead 40. In another embodiment, inkjet printhead assembly 12 is a wide-array or multi-head printhead assembly. In one wide-array embodiment, inkjet printhead assembly 12 includes a carrier, which carries printhead dies 40, provides electrical communication between printhead dies 40 and electronic controller 20, and provides fluidic communication between printhead dies 40 and ink supply assembly 14.

Figure 2:
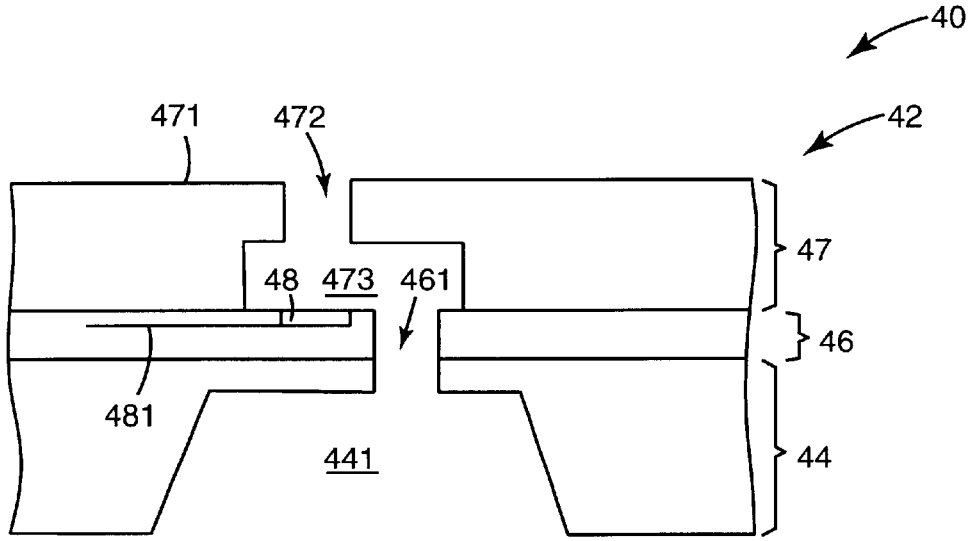
FIG. 2 is an enlarged schematic cross-sectional view illustrating portions of one embodiment of a printhead die in the printing system of FIG. 1.

A portion of one embodiment of a printhead die 40 is illustrated schematically in FIG. 2. Printhead die 40 includes an array of printing or drop ejecting elements 42. Printing elements 42 are formed on a substrate 44 which has an ink feed slot 441 formed therein. As such, ink feed slot 441 provides a supply of liquid ink to printing elements 42. Each printing element 42 includes a thin-film structure 46, an orifice layer 47, and a firing resistor 48. Thin-film structure 46 has an ink feed channel 461 formed therein which communicates with ink feed slot 441 of substrate 44. Orifice layer 47 has a front face 471 and a nozzle opening 472 formed in front face 471. Orifice layer 47 also has a nozzle chamber 473 formed therein which communicates with nozzle opening 472 and ink feed channel 461 of thin-film structure 46. Firing resistor 48 is positioned within nozzle chamber 473 and includes leads 481 which electrically couple firing resistor 48 to a drive signal and ground.

During printing, ink flows from ink feed slot 441 to nozzle chamber 473 via ink feed channel 461. Nozzle opening 472 is operatively associated with firing resistor 48 such that droplets of ink within nozzle chamber 473 are ejected through nozzle opening 472 (e.g., normal to the plane of firing resistor 48) and toward a print medium upon energization of firing resistor 48.

Example embodiments of printhead dies 40 include a thermal printhead, a piezoelectric printhead, a flex-tensional printhead, or any other type of inkjet ejection device known in the art. In one embodiment, printhead dies 40 are fully integrated thermal inkjet printheads. As such, substrate 44 is formed, for example, of silicon, glass, or a stable polymer and thin-film structure 46 is formed by one or more passivation or insulation layers of silicon dioxide, silicon carbide, silicon nitride, tantalum, poly-silicon glass, or other suitable material. Thin-film structure 46 also includes a conductive layer which defines firing resistor 48 and leads 481. The conductive layer is formed, for example, by aluminum, gold, tantalum, tantalum-aluminum, or other metal or metal alloy.

Printhead assembly 12 can include any suitable number (N) of printheads 40, here N is at least one. Before a print operation can be performed, data must be sent to printhead 40. Data includes, for example, print data and non-print data for printhead 40. Print data includes, for example, nozzle data containing pixel information, such as bitmap print data. Non-print data includes, for example, command/status (CS) data, clock data, and/or synchronization data. Status data of CS data includes, for example, printhead temperature or position, printhead resolution, and/or error notification.

Figure 3:
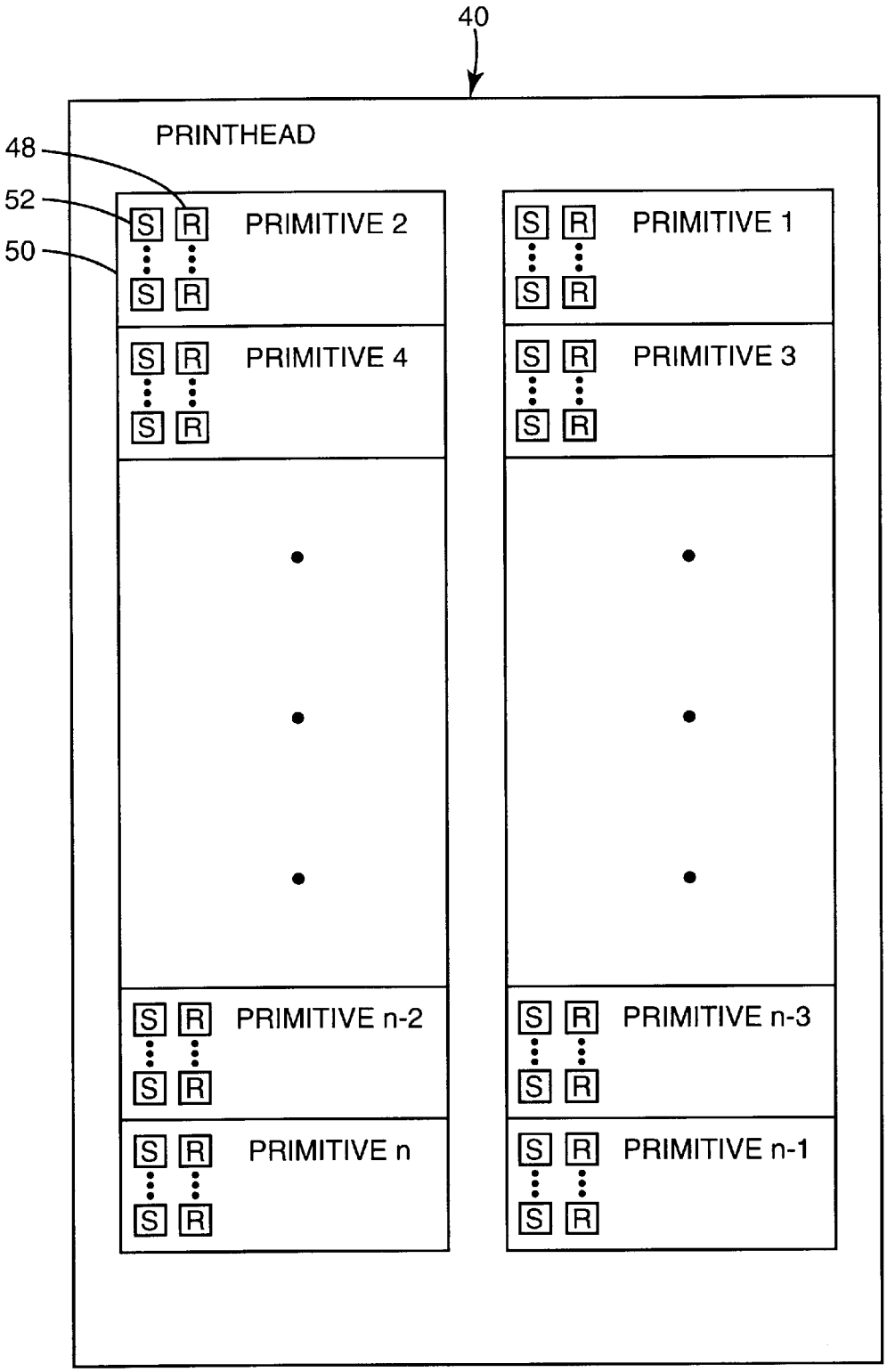
FIG. 3 is a block diagram illustrating portions of one embodiment of an inkjet printhead having firing resistors grouped together into primitives.

One embodiment of printhead 40 is illustrated generally in block diagram form in FIG. 3. Printhead 40 includes multiple firing resistors 48 which are grouped together into primitives 50. As illustrated in FIG. 3, printhead 40 includes N primitives 50. The number of firing resistors 48 grouped in a given primitive can vary from primitive to primitive or can be the same for each primitive in printhead 40. Each firing resistor 48 has an associated switching device 52, such as a field effect transistor (FET). A single power lead provides power to the source or drain of each FET 52 for each resistor in each primitive 50. Each FET 52 in a primitive 50 is controlled with a separately energizable address lead coupled to the gate of the FET 52. Each address lead is shared by multiple primitives 50. As described in detail below, the address leads are controlled so that in one embodiment, only one FET 52 is switched on at a given time so that only a single firing resistor 48 has electrical current passed through it to heat the ink in a corresponding selected vaporization chamber at the given time.

In the embodiment illustrated in FIG. 3, primitives 50 are arranged in printhead 40 in two columns of N/2 primitives per column. Other embodiments of printhead 40, however, have primitives arranged in many other suitable arrangements.

Figure 4:
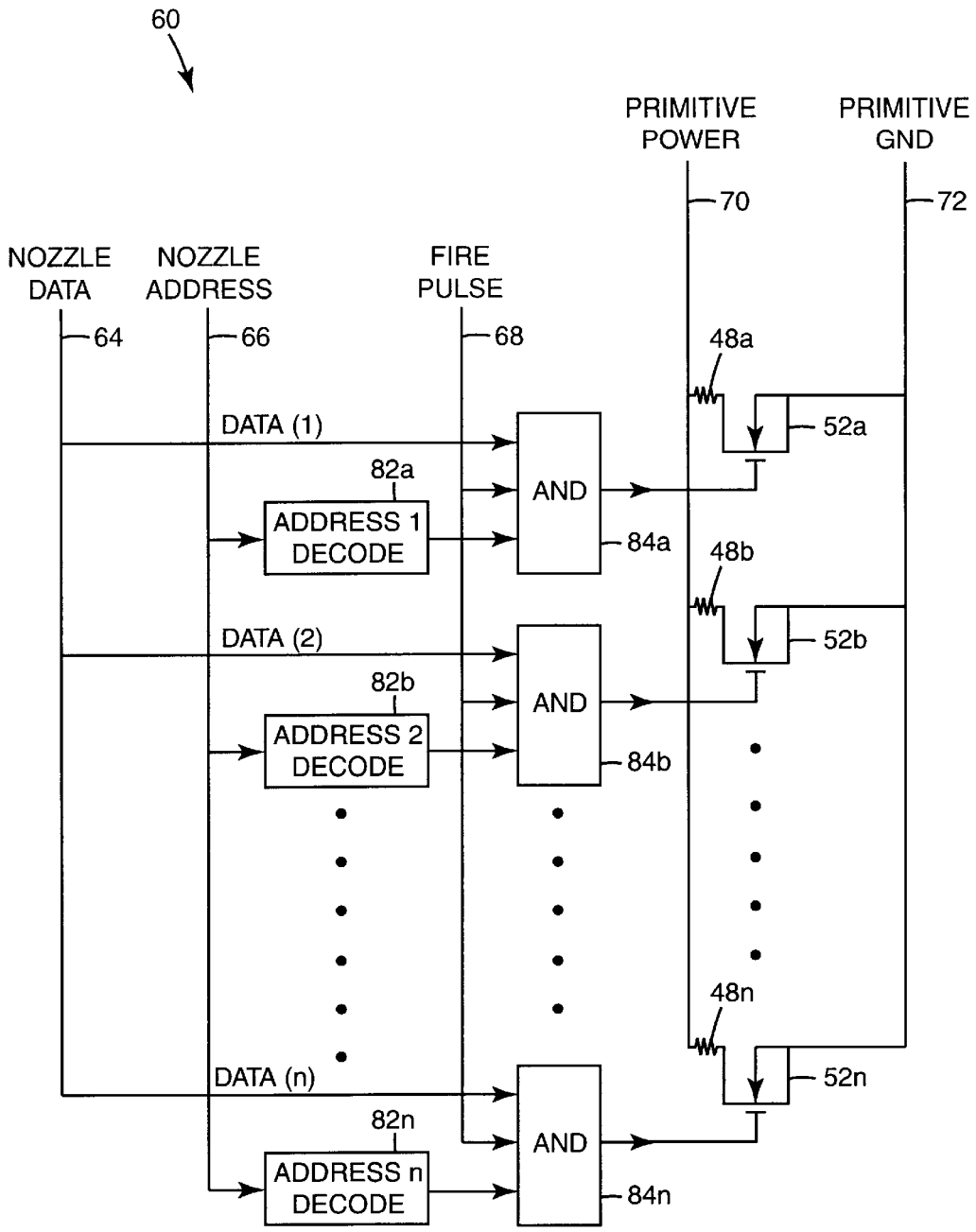
FIG. 4 is a block and schematic diagram illustrating portions of one embodiment of nozzle drive logic and circuitry employable in a primitive of an inkjet printhead.

Portions of one embodiment of nozzle drive logic and circuitry 60 of a primitive 50 are generally illustrated in block and schematic diagram form in FIG. 4. The portions illustrated in FIG. 4 represent the main logic and circuity for implementing the nozzle firing operation of nozzle drive logic and circuity 60. However, practical implementations of nozzle drive logic and circuitry 60 can include various other complex logic and circuitry not illustrated in FIG. 4.

Nozzle drive logic and circuitry 60 receives nozzle data on a path 64, a nozzle address on a path 66, and a fire pulse on a path 68. Nozzle drive logic and circuitry 60 also receives primitive power on a power line 70 and primitive ground on a ground line 72. Nozzle drive logic and circuitry 60 combines the nozzle data on path 64, the nozzle address on path 66, and the fire pulse on path 68 to sequentially switch electrical current from primitive power line 70 through firing resistors 48 to ground line 72. The nozzle data on path 64 represents the characters, symbols, and/or other graphics or images to be printed. The nozzle address on path 66 controls the sequence of which nozzle is to be fired at a given time (i.e., the nozzle firing order). The nozzle address on path 66 is cycled through so that all nozzles can be fired, but in one embodiment, only a single firing resistor 48 in primitive 50 is operated at a given time. The fire pulse on path 68 controls the timing of the activation of the electrical current from a power supply external to the printhead, such as power supply 22 (shown in FIG. 1).

In the embodiment of nozzle drive logic and circuitry 60 illustrated in FIG. 4, the nozzle address provided on path 66 is an encoded address. Thus, the nozzle address on path 66 is provided to N address decoders 82*a*, 82*b*, . . . , 82*n*. In this embodiment, the nozzle address on path 66 can represent one of N addresses representing one of N nozzles in the primitive 50. Accordingly, the address decoders 82 respectively provide an active output signal if the nozzle address on path 66 represents the nozzle associated with a given address decoder.

Nozzle drive logic and circuitry 60 includes AND gates 84*a*, 84*b*, . . . , 84*n*, which receive the N outputs from the address decoders 82*a*–82*n*. AND gates 84*a*–84*n* also respectively receive corresponding ones of the N nozzle data bits from path 64. AND gates 84*a*–84*n* also each receive the fire pulse provided on path 68. The outputs of AND gates 84*a*–84*n* are respectively coupled to corresponding control gates of FETs 52*a*–52*n*. Thus, for each AND gate 84, if the corresponding nozzle 13 has been selected to receive data based on the nozzle data input bit from path 64, the fire pulse on line 68 is active, and the nozzle address on line 66 matches the address of the corresponding nozzle, the AND gate 84 activates its output which is coupled to the control gate of a corresponding FET 52.

Each FET 52 has its source coupled to primitive ground line 72 and its drain coupled to a corresponding firing resistor 48. Firing resistors 48*a*–48*n* are respectively coupled between primitive power line 70 and the drains of corresponding FETs 52*a*–52*n*.

Thus, when the combination of the nozzle data bit, the decoded address bit, and the fire pulse provide three active inputs to a given AND gate 84, the given AND gate 84 provides an active pulse to the control gate of the corresponding FET 52 to thereby turn on the corresponding FET 52 which correspondingly causes current to be passed from primitive power line 70 through the selected firing resistor 48 to primitive ground line 72. The electrical current being passed through the selected firing resistor 48 heats the ink in a corresponding selected vaporization chamber to cause the ink to vaporize and be ejected from the corresponding nozzle 13.

Figure 5:
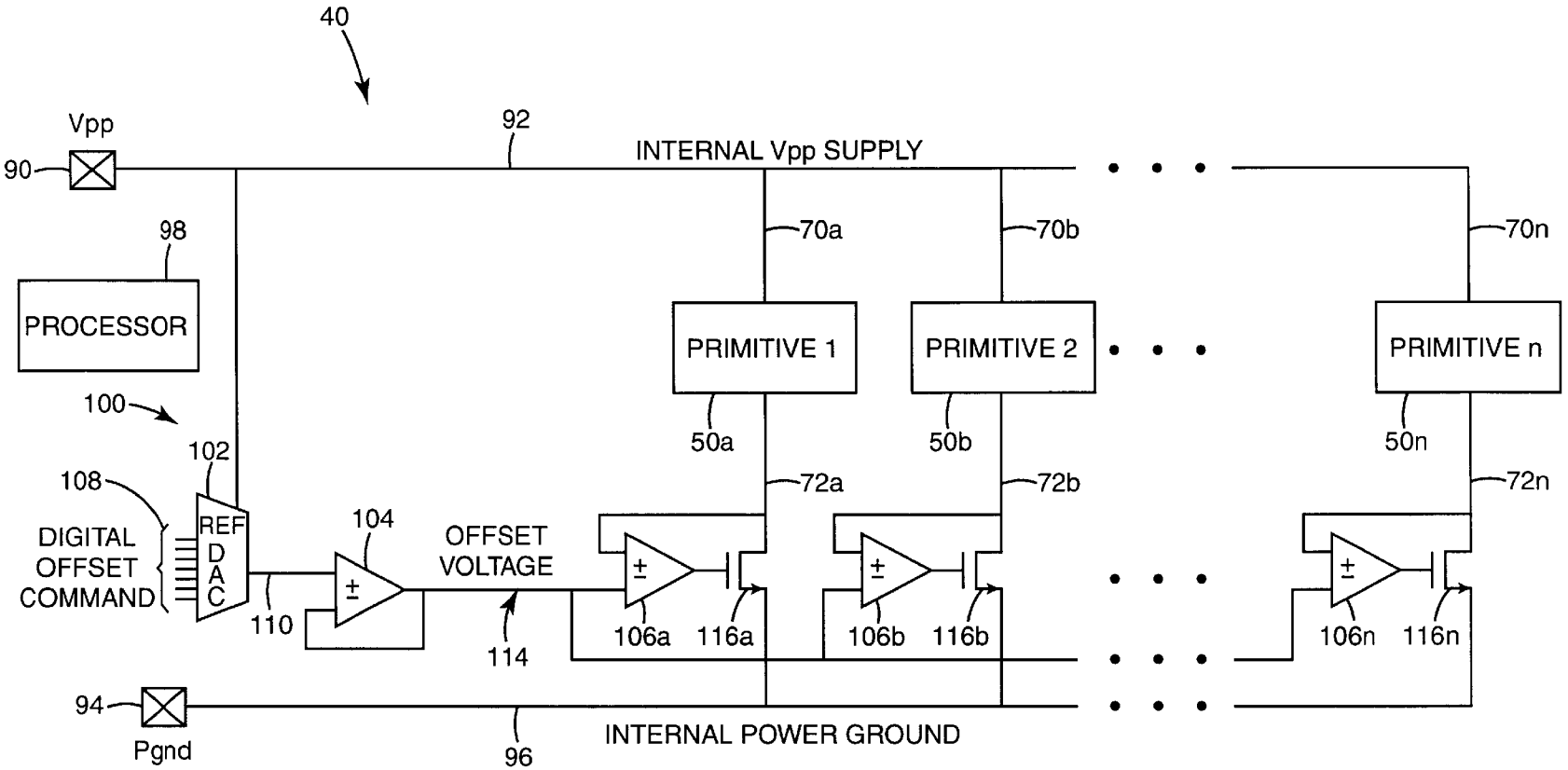
FIG. 5 is a block and schematic diagram illustrating portions of one embodiment of an inkjet printhead having integrated control of power delivery to firing resistors.

One embodiment of a printhead 40 having a linear power regulator 100 is illustrated generally in block and schematic diagram form in FIG. 5. Printhead 40 employs linear power regulator 100 to compensate for off-printhead die parasitic resistances which cause the power supply voltage (Vpp) to sag at the input to printhead 40. Printhead 40 receives Vpp power from power supply 22 at Vpp input pin(s) 90 and receives a corresponding power ground at input pin(s) 94. An internal Vpp power supply path 92 is coupled to Vpp power pins 90 to internally supply Vpp power to the firing resistors 48 in printhead 40. An internal power ground 96 is coupled to power ground pins 94 to internally supply the corresponding power ground to the firing resistors 48 in printhead 40.

Each of the primitives 50*a*–50*n* includes a corresponding one of the primitive power lines 70*a*–70*n* which is directly coupled to the internal Vpp power supply path 92. Each of the primitives 50*a*–50*n* includes a corresponding one of the primitive ground lines 72*a*–72*n* which is not directly coupled to the internal power ground 96. Rather, primitive ground lines 72*a*–72*n* are controlled with linear power regulator 100 according to the present invention.

Linear power regulator 100 includes a current-mode digital-to-analog converter (DAC) 102, a buffer amplifier 104, and a series of feedback amplifiers 106*a*, 106*b*, . . . , 106*n*. Each of the feedback amplifiers 106*a*–106*n* corresponds to a corresponding one of the primitives 50*a*–50*n*, where each primitive 50 can in one embodiment, only have one firing resistor 48 energized at a given time.

DAC 102 receives a digital offset command on lines 108. The internal Vpp power supply path 92 is coupled to DAC 102 and provides a reference voltage for DAC 102. DAC 102 is programmed by the digital offset command on lines 108 to produce an analog offset voltage from the internal Vpp power supply path 92 voltage to thereby track any movement of the Vpp power supply at the Vpp input pins 90 of printhead 40. The digital offset command on lines 108 represents the amount of offset voltage necessary to compensate for off-printhead die parasitic resistances that cause the Vpp power supply voltage to sag at the input to printhead 40.

In one embodiment, printhead 40 includes a processor 98 which provides the digital offset command on lines 108. In another embodiment, the digital offset command is provided by electronic controller 20 to printhead 40. In yet another embodiment, the digital offset command on lines 108 is provided by a processor external to the printhead(s) 40 but contained within printhead assembly 12. In any of these embodiments, the digital offset command is typically stored in a register which is read and written by a processor, such as processor 98, via an internal bus of printhead 40.

DAC 102 coverts the digital offset command on lines 108 to the analog offset voltage from the internal Vpp power supply path voltage and provides the analog offset voltage on line 110. The analog offset voltage provided on line 110 is coupled to the positive input of buffer amplifier 104. Buffer amplifier 104 has a unity gain and provides a buffered offset voltage on a line 114 having a low-impedance output characteristic so that the offset voltage on line 114 can be distributed across the printhead die 40. The offset voltage on line 114 is fed back to the negative input of buffer amplifier 104.

The offset voltage on line 114 is provided to the negative input terminal of each feedback amplifier 106*a*–106*n*. The positive input of each feedback amplifier 106*a*–106*n* is respectively coupled to a corresponding one of the primitive ground lines 72*a*–72*n*. The output of each feedback amplifier 106*a*–106*n* is respectively coupled to the gate of a corresponding FET 116*a*, 116*b*, . . . , 116*n*.

The source of each FET 116*a*–116*n* is coupled to internal power ground 96. The drain of each FET 116*a*–116*n* is respectively coupled to a corresponding one of the primitive ground lines 72*a*–72*n*. The feedback configuration between each FET 116 and feedback amplifier 106 forces the buffered offset voltage on line 114 to the respective primitive ground line 72.

In one embodiment, only one resistor 48 inside of each primitive 50 can be energized at a given time. An energized firing resistor 48 in a given primitive 50 has the offset voltage coupled to its low-side instead of the internal power ground 96 and the internal Vpp power supply path 92 coupled to its high-side. Since the high-side of the energized firing resistor 48 is coupled to the internal Vpp power supply path 92, the energized firing resistor 48 has a constant voltage across it equal to a difference of the Vpp voltage and the programmed offset voltage even if the Vpp voltage sags. This tracking of Vpp voltage movement results in a substantially constant power being delivered to the energized firing resistors 48 in printhead 40.

Figure 6:
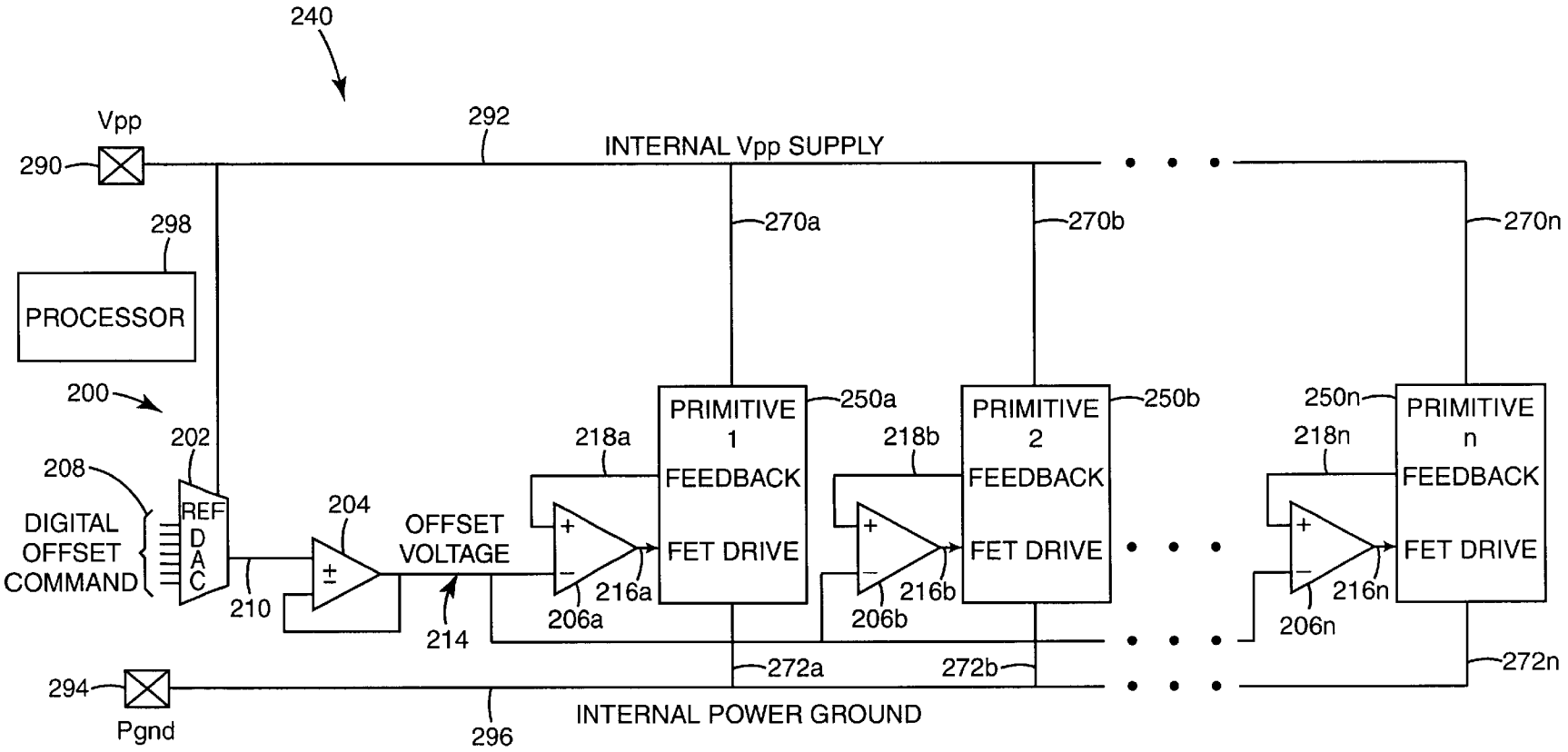
FIG. 6 is a block and schematic diagram illustrating portions of another embodiment of an inkjet printhead having integrated control of power delivery to firing resistors.

An alternative embodiment of a printhead 240 having a linear power regulator 200 is illustrated generally in block and schematic diagram form in FIG. 6. Printhead 240 employs linear power regulator 200 to compensate for off-printhead die parasitic resistances which cause the power supply voltage (Vpp) to sag at the input to printhead 240. Printhead 240 receives Vpp power from power supply 22 at Vpp input pin(s) 290 and receives a corresponding power ground at input pin(s) 294. An internal Vpp power supply path 292 is coupled to Vpp power pins 290 to internally supply Vpp power to the firing resistors 248 (shown in FIG. 7) in printhead 240. An internal power ground 296 is coupled to power ground pins 294 to internally supply the corresponding power ground to the firing resistors 248 in printhead 240.

Each of N primitives 250*a*, 250*b*, . . . , 250*n* includes a corresponding one of primitive power lines 270*a*, 270*b*, . . . , 270*n* which is directly coupled to the internal Vpp power supply path 292. Each of the primitives 250*a*–250*n* includes a corresponding one of primitive ground lines 272*a*, 272*b*, . . . , 272*n* which is directly coupled to the internal power ground 296.

Linear power regulator 200 includes a current-mode digital-to-analog converter (DAC) 202, a buffer amplifier 204, and a series of feedback amplifiers 206*a*, 206*b*, . . . , 206*n*. Each of the feedback amplifiers 206*a*–206*n* corresponds to a corresponding one of the primitives 250*a*–250*n*, where each primitive 250 can in one embodiment, only have one firing resistor 248 energized at a given time.

DAC 202 receives a digital offset command on lines 208. The internal Vpp power supply path 292 is coupled to DAC 202 and provides a reference voltage for DAC 202. DAC 202 is programmed by the digital offset command on lines 208 to produce an analog offset voltage from the internal Vpp power supply path 292 voltage to thereby track any movement of the Vpp power supply at the Vpp input pins 290 of printhead 240. The digital offset command on lines 208 represents the amount of offset voltage necessary to compensate for off-printhead die parasitic resistances that cause the Vpp power supply voltage to sag at the input to printhead 240.

In one embodiment, printhead 240 includes a processor 298 which provides the digital offset command on lines 208. In another embodiment, the digital offset command is provided by electronic controller 20 to printhead 240. In yet another embodiment, the digital offset command on lines 208 is provided by a processor external to the printhead(s) 240 but contained within printhead assembly 12. In any of these embodiments, the digital offset command is typically stored in a register which is read and written by a processor, such as processor 298, via an internal bus of printhead 240.

DAC 202 coverts the digital offset command on lines 208 to the analog offset voltage from the internal Vpp power supply path voltage and provides the analog offset voltage on line 210. The analog offset voltage provided on line 210 is coupled to the positive input of buffer amplifier 204. Buffer amplifier 204 has a unity gain and provides a buffered offset voltage on a line 214 having a low-impedance output characteristic so that the offset voltage on line 214 can be distributed across the printhead die 240. The offset voltage on line 214 is fed back to the negative input of buffer amplifier 204.

The offset voltage on line 214 is provided to the negative input terminal of each feedback amplifier 206*a*–206*n*. The positive input of each feedback amplifier 206*a*–206*n* is respectively coupled to a corresponding one of feedback lines 218*a*, 218*b*, . . . , 218*n* of primitives 250*a*–250*n*. The output of each feedback amplifier 206*a*–206*n* is respectively coupled to a corresponding one of FET drive lines 216*a*, 216*b*, . . . , 218*n* of primitives 250*a*–250*n*.

Figure 7:
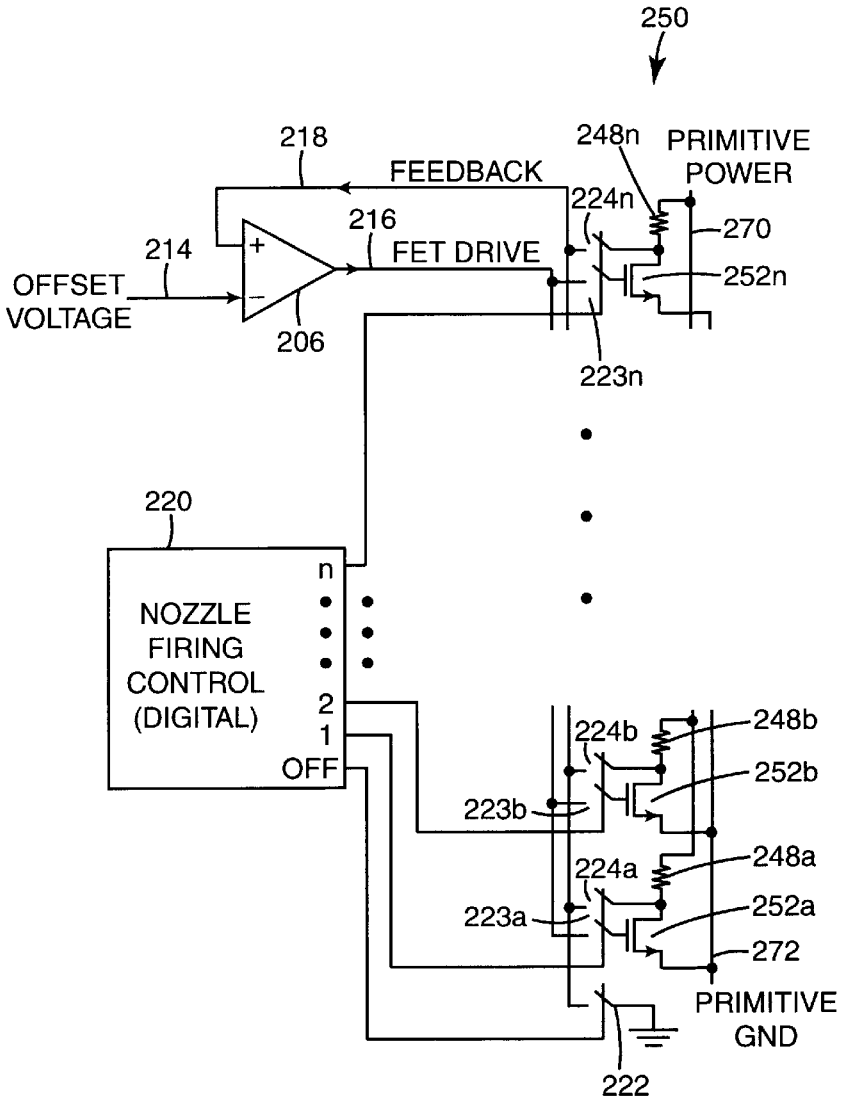
FIG. 7 is a block and schematic diagram illustrating portions of one embodiment of a primitive of the inkjet printhead of FIG. 6.

Portions of one embodiment of a primitive 250 of printhead 240 are generally illustrated in block and schematic diagram form in FIG. 7. Primitive 250 includes N firing resistors 248*a*, 248*b*, . . . , 248*n*. Each firing resistor 248 has a first terminal coupled to primitive power line 270. Primitive 250 includes N power FETs 252*a*, 252*b*, . . . , 252*n*. Each power FET 252 has its source coupled to primitive ground line 272 and its drain coupled to a second terminal of a corresponding firing resistor 248.

A digital nozzle firing controller 220 has N outputs for controlling N pairs of analog switches (223*a*, 224*a*), (223*b*, 224*b*), . . . , (223*n*, 224*n*). In addition, nozzle firing controller 220 has an off output, which when activated controls a switch 222 to disable all firing resistors 248 in primitive 250. In one embodiment, the N other outputs of nozzle firing controller 220 are operated with a digital state machine or other suitable logic so that at most only one of the N outputs are active at a given time so that at most only one switch pair (223, 224) is switched on at a given time. Switches 222, 223, and 224 can be implemented with low-impedance non-power FETs.

Each switch 223 is coupled between a control gate of a corresponding power FET 252 and the FET drive line 216 provided as the output of feedback amplifier 206. Each switch 224 is coupled between the second terminal of a corresponding firing resistor 248 and the feedback line 218 provided to the positive input of feedback amplifier 206.

Thus, in operation, when nozzle firing controller 220 selects a switch pair (223, 224) to be turned on, the FET drive line 216 is coupled to the control gate of the corresponding selected power FET 252 and the feedback line 218 is coupled to the second terminal of the corresponding selected firing resistor 248 and to the drain of the selected power FET 252. This feedback configuration between the selected power FET 252 and feedback amplifier 206 provides the offset voltage 214 on feedback line 218 to the second terminal of the selected firing resistor 248. Since, the selected firing resistor 248 also has the primitive power line coupled to its first input, the selected firing resistor is energized and electrical current is passed through the firing resistor to heat the ink in a corresponding selected vaporization chamber.

In one embodiment, only one resistor 248 inside of each primitive 250 can be energized at a given time. An energized firing resistor 248 in a given primitive 250 has the offset voltage coupled to its low-side instead of the internal power ground 296 and the internal Vpp power supply path 292 coupled to its high-side. Since the high-side of the energized firing resistor 248 is coupled to the internal Vpp power supply path 292, the energized firing resistor 248 has a constant voltage across it equal to a difference of the Vpp voltage and the programmed offset voltage even if the Vpp voltage sags. This tracking of Vpp voltage movement results in a substantially constant power being delivered to the energized firing resistors 248 in printhead 240.

The linear power regulator 100/200 of printhead 40/240 permits a fixed applied power to the energized firing resistors 48/248 and a fixed duration for which the applied power is applied to the energized firing resistors 48/248. In this way, the amount of power delivered to the firing resistors is kept at a substantially constant level, even when only a few firing resistors are energized at a given time. The reduced power variation increases the firing resistor life, which thereby yields a longer life for the printhead 40/240 according to the present invention.

The above-described linear power regulator 100/200 has the program offset voltage to offset changes in the internal Vpp power supply path voltage to obtain substantially constant power delivered to the energized firing resistor 48/248 in the printhead 40/240. Nevertheless, the regulation limits of the linear power regulator 100/200 are within a regulation band defined by an upper set point offset voltage and a lower set point offset voltage. The upper and lower set point offset voltages are based on the size of the switching transistor 52/252, the size of the firing resistor 48/248, and many external factors. Thus, in the final assembly of the printhead 40/240, the printhead needs to be calibrated to determine the upper and lower set point offset voltages.

In one embodiment, electronic controller 20 performs an external calibration of the printhead 40/240 to determine the upper and lower set point offset voltages of the linear power regulator 100/200.

Figure 8:
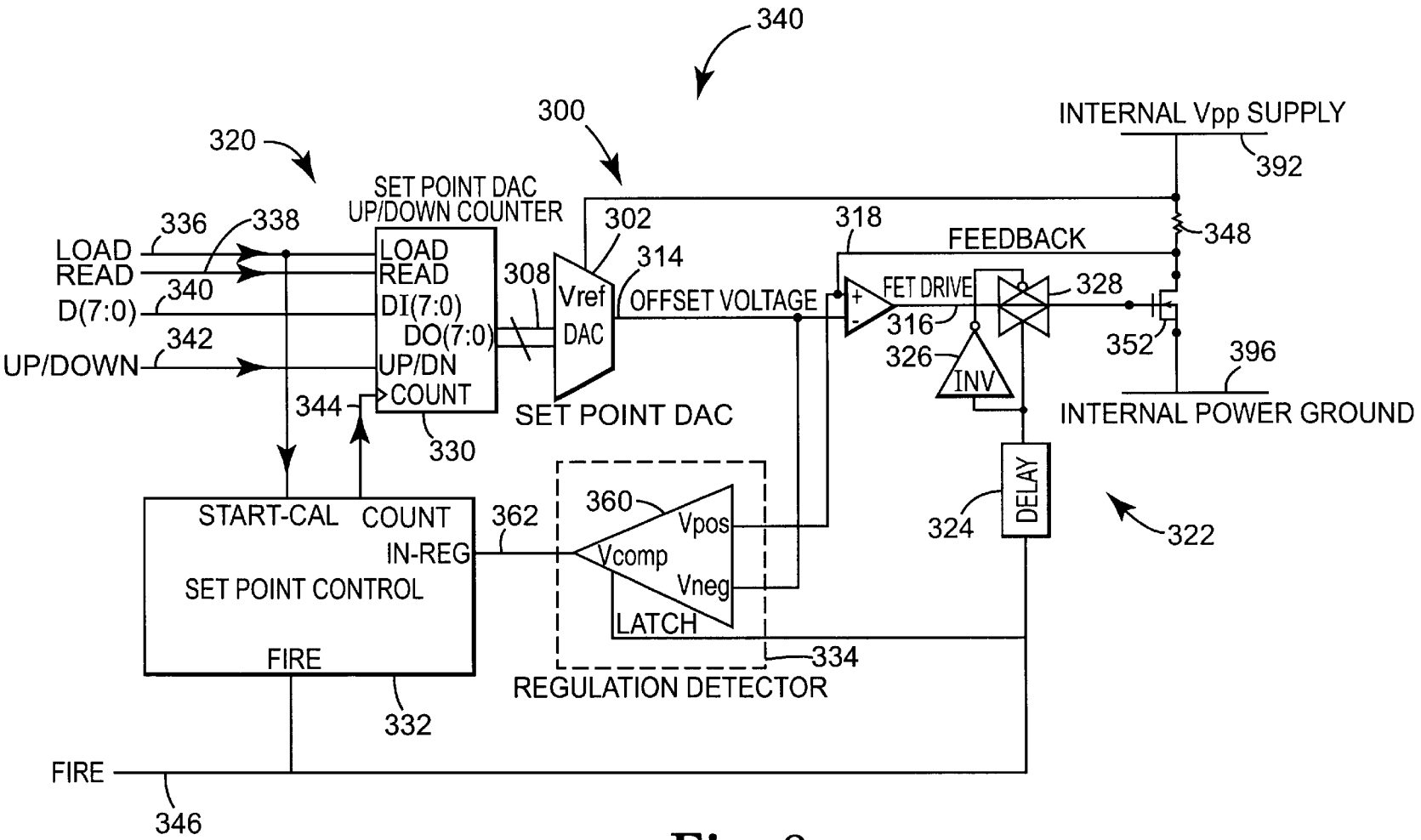
FIG. 8 is a block and schematic diagram illustrating portions of one embodiment of an inkjet printhead having a self-calibration circuit for integrated power delivery control to firing resistors.

One embodiment of a printhead 340, which includes a linear power regulator 300 having a power delivery control loop 322 and a power delivery self-calibration circuit 320, is illustrated generally in block and schematic diagram form in FIG. 8. Printhead 340 employs linear power regulator 300 to compensate for off-printhead die parasitic resistances which cause the power voltage (Vpp) to sag at the input of printhead 340. For clarity, the below described power delivery control loop 322 and power delivery self-calibration circuit 320 are described and illustrated in FIG. 8 relative to only one of the many firing resistors 348 and its corresponding power FET 352. When the selected FET 352 is switched on, electrical current is passed through the corresponding selected firing resistor 348 to heat ink in a corresponding selected vaporization chamber to cause ink to vaporize and be ejected from the corresponding nozzle.

Power delivery controller loop 322 includes firing resistor 348, power FET 352, a feedback amplifier 306, a delay element 324, an inverter 326, and a transistor firing controller 328.

Linear power regulator 300 includes a current-mode set point digital-to-analog converter (DAC) 302 which receives a digital offset command on lines 308. An internal Vpp supply 392 is provided to one terminal of firing resistor 348 and is coupled to a Vref input to set point DAC 302 to provide a reference voltage for DAC 302. Set point DAC 302 is programmed by the digital offset command on lines 308 to produce an analog offset voltage from the internal Vpp power supply path 392 voltage to thereby track any movement of the Vpp power supply at the Vpp input pins of printhead 340. The digital offset command on lines 308 represents the amount of offset voltage necessary to compensate for off-printhead die parasitic resistances that cause the Vpp power supply voltage to sag at the input of printhead 340.

Set point DAC 302 converts the digital offset command on lines 308 to an analog offset voltage from the internal Vpp power supply path voltage and provides the analog offset voltage on line 314. In one embodiment, the analog offset voltage on line 314 is provided in a manner similar to that described above for providing the offset voltage on line 214 with buffer amplifier 204 in printhead 240 illustrated in FIGS. 6–7. As illustrated in FIG. 8, the offset voltage on line 314 is provided to the negative input terminal of feedback amplifier 306. The positive input of feedback amplifier 306 is coupled to a feedback line 318. The output of feedback amplifier 306 is coupled to a FET drive line 316.

Firing resistor 348 has a first terminal coupled to internal Vpp supply 392 and a second terminal coupled to feedback line 318. Power FET 352 has its source coupled to an internal power ground 396 and its drain coupled to the second terminal of firing resistor 348.

A fire pulse, which could, for example, be generated by electronic controller 20, is provided on a line 346 to delay element 324, which provides a delayed fire pulse to a first control input of transistor firing controller 328. The delayed fire pulse is inverted by inverter 326 and provided to a second control input of transistor firing controller 328. FET drive line 316 is coupled to a third input of transistor firing controller 328. As illustrated in the simplified diagram of FIG. 8, the fire pulse on line 346 controls the activation of transistor firing controller 328 to provide the FET drive signal on line 316 to the gate of power FET 352 to turn on power FET 352.

Thus, in operation, when a nozzle firing controller (not shown in FIG. 8, but such as described above and illustrated at 220 in FIG. 7) selects a firing resistor to be turned on, the FET drive line 316 is coupled to the control gate of the selected power FET 352 and the feedback line 318 is coupled to the second terminal of the selected firing resistor 348 and to the drain of the selected power FET 352. This feedback configuration between the selected power FET 352 and feedback amplifier 306 substantially provides the analog offset voltage on line 314 to feedback line 318 and thereby to the second terminal of the selected firing resistor 348. Since, the selected firing resistor 348 also has the internal Vpp supply 392 coupled to its first input, the selected firing resistor is energized and electrical current is passed through the firing resistor to heat the ink in a corresponding selected vaporization chamber.

In one embodiment, only one firing resistor 348 inside of each primitive can be energized at a given time. An energized firing resistor 348 in a given primitive has the offset voltage coupled to its low-side instead of internal ground 396 and the internal Vpp power supply path 392 coupled to its high side. Since the high-side of the energized firing resistor 348 is coupled to the internal Vpp power supply path 392, the energized firing resistor 348 has a constant voltage across it equal to a difference of the Vpp voltage and the programmed offset voltage even if the Vpp voltage sags. This tracking of Vpp voltage movement results in a substantially constant power being delivered to the energized firing resistors 348 in printhead 340.

In the embodiment of printhead 340 illustrated in FIG. 8, the selected firing resistor 348 has the corresponding selected power FET 252 coupled to its low-side. Similarly, the portion of printhead 40 illustrated in FIG. 4 has each power FET 52 coupled to the low-side of the corresponding firing resistor 48 and the portion of printhead 240 illustrated in FIG. 7 has each power FET 252 coupled to the low-side of the corresponding firing resistor 248. These printhead configurations are referred to as low-side power FET switching configurations. Other embodiments of inkjet printheads are configured to have the power FETs coupled between the internal Vpp power supply path and the high-side of the corresponding firing resistor. In these high-side power FET switching configuration embodiments of printheads having power regulators similar to as described above, the selected firing resistor in a given primitive has the offset voltage coupled to its low-side similar to the low-side power FET switching configurations, but the high-side power FET switching configurations have the selected power FET coupled between the internal Vpp power supply path and the high-side of the corresponding firing resistor. Therefore, in both the low-side and high-side power FET switching configurations of printheads having power regulators, an energized firing resistor in a given primitive has the offset voltage coupled to its low-side and the internal Vpp power supply path coupled to its high-side.

In one embodiment, when power delivery control loop 322 is in regulation, the offset voltage on feedback line 318 is slightly less than the offset voltage on line 314. If the offset voltage on feedback line 318 is too high, the power delivery control loop 322 draws more current through power FET 352 causing a larger voltage drop across firing resistor 348 and consequently reducing the offset voltage on feedback line 318. If the offset voltage on feedback line 318 is too low, less current is drawn through power FET 352 causing a smaller voltage drop across firing resistor 348 and consequently an increased offset voltage on feedback line 318. Essentially, the power delivery control loop 322 maintains the offset voltage on feedback line 318 substantially at the offset voltage on line 314 when the power delivery control loop is in regulation. In one embodiment, the offset voltage on feedback line 318 is within a few millivolts of the offset voltage on line 314 when power delivery control loop 322 is in regulation.

The power delivery self-calibration circuit 320 includes a set point DAC up/down counter 330, a set point control block 332, and a regulation detector 334.

Set point DAC up/down counter 330 receives a load signal on line 336, a read signal on line 338, data (7:0) on data lines 340, and an up/down signal on line 342. Set point DAC up/down counter 330 provides the digital offset command on lines 308. In the example embodiment illustrated in FIG. 8, data lines 340 include eight data lines, but any suitable number of data lines can be used. In one embodiment, the data on data lines 340 are provided via an internal data bus to printhead 340. In one embodiment, the load, read, data, and up/down signals respectively on lines 336, 338, 340, and 342 are provided via electronic controller 20.

The load signal on line 336 is also provided to a start calculation input to set point control block 332. Set point control block 332 provides a count signal on a line 344 to set point DAC up/down counter 330. Set point DAC up/down counter 330 counts up or down in response to receiving an active count signal on line 344 and the counting direction is based on the status of the up/down signal on line 342.

The fire pulse on line 346 is provided to a fire input of set point control block 332 and to a latch input of regulation detector 334. Regulation detector 334 includes a comparator circuit 360 which receives the offset voltage on line 314 at a Vneg input and the offset voltage on feedback line 318 at a Vpos input. Comparator circuit 360 compares the offset voltage on line 314 to the offset voltage on feedback line 318 in response to receiving an active fire pulse at the latch input and indicates an in regulation condition on a line 362 to an in-reg input of set point control block 332 when the values of the offset voltage on line 314 and the offset voltage on feedback line 318 are sufficiently close to thereby indicate that the power delivery control loop 322 is in regulation. In one example embodiment, when the offset voltage on feedback line 318 is approximately within a few millivolts of the offset voltage on line 314, with an active fire pulse at the latch input 334, comparator circuit 360 provides an active in regulation signal on line 362. Typically, when power delivery control loop 322 is in regulation, the offset voltage on feedback line 318 is slightly less than the offset voltage on line 314. The delay element 324 functions to allow the regulation detector 334 circuit to have sufficient time to respond, stabilize, and settle before the fire pulse on line 346 is turned off.

In operation, set point control block 332 issues a count signal on line 344 at every fire pulse on line 346 unless an active in regulation signal has been received from regulation detector 334 on line 362. Set point control block 332 includes a state machine which is initialized and reset in response to an active load signal on line 336. Once the set point control block state machine has been initialized and set point control block 332 receives an active in regulation signal from regulation detector 334, set point control block 332 inhibits the count signal on line 344 from being activated until the next active load signal on line 336 is received to reset the internal state machine of set point control block 332.

In a self-calibrating set point calculation operation to determine the lower set point offset voltage, electronic controller 20 presets set point DAC up/down counter 330 to a sufficiently low value to generate a set point offset voltage below the regulation band of the power delivery control loop 322. The preset set point offset voltage digital value is loaded in response to the activation of the load signal on line 336 and the data (7:0) is loaded from data lines 340. In one embodiment, a digital value of 0 is placed on data lines 340 as the initial set point offset voltage to guarantee that the value is sufficiently low to generate an analog set point offset voltage on line 314 below the regulation band of the power delivery control loop 322.

Electronic controller 20 provides a fire pulse on line 346 to enable the power delivery control loop 322 and regulation detector 334. In this embodiment, when the fire pulse on line 346 terminates, set point control block 332 evaluates the state of regulation detector 334 via the in regulation signal on line 362 and activates the count signal to set point DAC up/down counter 330 only if the in regulation signal on line 362 indicates that the power delivery control loop 322 is out of regulation and had never previously indicated that the power delivery control loop 322 was in regulation since the last initialization of the internal state machine of set point control block 332. Set point DAC up/down counter 330 is incremented in response to the activated count signal on line 344.

Additional fire pulses are provided from electronic controller 20 until the stored digital value in set point DAC up/down counter 330 reaches an lower set point offset voltage which brings the power delivery control loop 322 into regulation. At this point, set point control block 332 inhibits any further count signal activations on line 344 until the next preset command is issued from electronic controller 20 via load line 336.

In this way, set point DAC counter 330 contains the digital register value that defines the lower set point offset voltage for the current value of internal Vpp supply voltage 392. The lower set point offset voltage digital value can be read by electronic controller 20 via data lines 340 by activating the read signal on line 338.

In a self-calibrating set point calculation operation to determine the upper set point offset voltage, electronic controller 20 presets set point DAC up/down counter 330 to a sufficiently high value to generate a set point offset voltage above the regulation band of the power delivery control loop 322. The preset set point offset voltage digital value is loaded in response to the activation of the load signal on line 336 and the data (7:0) is loaded from data lines 340. In one embodiment, a digital value of 255 is placed on data lines 340 as the initial set point offset voltage to guarantee that the value is sufficiently high to generate an analog set point offset voltage on line 314 above the regulation band of the power delivery control loop 322.

Electronic controller 20 provides a fire pulse on line 346 to enable the power delivery control loop 322 and regulation detector 334. In this embodiment, when the fire pulse on line 346 terminates, set point control block 332 evaluates the state of regulation detector 334 via the in regulation signal on line 362 and activates the count signal to set point DAC up/down counter 330 only if the in regulation signal on line 362 indicates that the power delivery control loop 322 is out of regulation and had never previously indicated that the power delivery control loop 322 was in regulation since the last initialization of the internal state machine of set point control block 332. Set point DAC up/down counter 330 is decremented in response to the activated count signal on line 344.

Additional fire pulses are provided from electronic controller 20 until the stored digital value in set point DAC up/down counter 330 reaches an upper set point offset voltage which brings the power delivery control loop 322 into regulation. At this point, set point control block 332 inhibits any further count signal activations on line 344 until the next preset command is issued from electronic controller 20 via load line 336.

In this way, set point DAC counter 330 contains the digital register value that defines the upper set point offset voltage for the current value of internal Vpp supply voltage 392. The upper set point offset voltage digital value can be read by electronic controller 20 via data lines 340 by activating the read signal on line 338.

Electronic controller or system controller 20 does not have to monitor that status of the printing system or printhead 340, because set point control block 332 ensures that the set point offset voltage value is retained in set point DAC counter 330 regardless of how many subsequent fire pulses are provided from electronic controller 20. This calibration process is significantly simpler than a calibration process in which electronic controller is required to monitor the status of the printing system and printhead 340. Since electronic controller 20 does not need to monitor the status of the printing system and printhead 340, printhead 340 is self-calibrating to determine the lower set point offset voltage and the upper set point offset voltage.

In one embodiment, electronic controller blindly sends 256 fire pulses to determine the lower set point offset voltage and 256 fire pulses to determine the upper set point offset voltage. In this embodiment, set point DAC counter 330 could potentially count up from 0 to 255, but is held at the lower set point offset voltage value that is the lowest value which obtains regulation of the power delivery control loop 322. Similarly, in this embodiment, set point DAC counter

330 could potentially count down from 255 to 0, but is held at the upper set point offset voltage value that is the highest value which obtains regulation of the power delivery control loop 322. In another embodiments, electronic controller 20 can reduce the number of fire pulse cycles required to determine the lower and upper set point offset voltages with some knowledge of the lowest possible value or highest possibly value for the lower and upper set point offset voltages.

Although specific embodiments have been illustrated and described herein for purposes of description of the preferred embodiment, it will be appreciated by those of ordinary skill in the art that a wide variety of alternate and/or equivalent implementations calculated to achieve the same purposes may be substituted for the specific embodiments shown and described without departing from the scope of the present invention. Those with skill in the chemical, mechanical, electro-mechanical, electrical, and computer arts will readily appreciate that the present invention may be implemented in a very wide variety of embodiments. This application is intended to cover any adaptations or variations of the preferred embodiments discussed herein. Therefore, it is manifestly intended that this invention be limited only by the claims and the equivalents thereof.

What is claimed is:

1. A fluid ejection device comprising:

an internal power supply path;

a power regulator providing an offset voltage from the internal power supply path voltage, the power regulator including a self-calibration circuit adapted to determine a regulation band of the power regulator defined by a lower set point offset voltage and an upper set point offset voltage, wherein the power regulator includes:

a digital-to-analog converter (DAC) coupled to the internal power supply path and configured to receive a digital offset command representing a desired offset voltage and to provide an analog offset voltage from the internal power supply path voltage; and a feedback amplifier having a first input coupled to the analog offset voltage, a second input coupled to a feedback line, and an output coupled to a drive line;

a group of nozzles;

a corresponding group of firing resistors; and a corresponding group of switches controllable to couple a selected firing resistor of the group of firing resistors between the internal power supply path and the offset voltage to thereby permit electrical current to pass through the selected firing resistor to cause a corresponding selected nozzle to fire;

wherein a selected firing resistor of the group of firing resistors includes a first terminal and a second terminal coupled to the feedback line, wherein the drive line provides the offset voltage to the feedback line and the second terminal of the selected firing resistor; and wherein a selected switch corresponding to a selected firing resistor has a control gate controlled by the drive line.

2. The fluid ejection device of claim 1 wherein the self-calibrating circuit includes:

a regulation detector configured to compare the analog offset voltage at the first input of the feedback amplifier and the offset voltage on the feedback line and provide an in regulation signal which is activated based on the power regulator being in regulation.

3. The fluid ejection device of claim 1 further comprising:

an internal power ground;

wherein the first terminal of the selected firing resistor is coupled to the internal power supply path; and wherein the selected switch is coupled between the second terminal of the firing resistor and the internal power ground.

4. The fluid ejection device of claim 1 wherein the selected switch is coupled between the internal power supply path and the first terminal of the selected firing resistor.

5. The fluid ejection device of claim 1 wherein the self-calibration circuit includes:

a set point DAC up/down counter storing a set point offset voltage digital value which is provided as the digital offset command.

6. A fluid ejection device comprising:

an internal power supply path;

a power regulator providing an offset voltage from the internal power supply path voltage, the power regulator including a self-calibration circuit adapted to determine a regulation band of the power regulator defined by a lower set point offset voltage and an upper set point offset voltage, wherein the power regulator includes:

a digital-to-analog converter (DAC) coupled to the internal power supply path and configured to receive a digital offset command representing a desired offset voltage and to provide an analog offset voltage from the internal power supply path voltage; and a group of nozzles;

a corresponding group of firing resistors; and a corresponding group of switches controllable to couple a selected firing resistor of the group of firing resistors between the internal power supply path and the offset voltage to thereby permit electrical current to pass through the selected firing resistor to cause a corresponding selected nozzle to fire;

wherein the self-calibration circuit includes:

a set point DAC up/down counter storing a set point offset voltage digital value which is provided as the digital offset command; and a set point controller receiving a fire pulse, a start calculation signal, and an in regulation signal which is activated based on the power regulator being in regulation, the set point controller activating a count signal to the set point DAC up/down counter at every received fire pulse in a first set point calculation operation occurring between a first active start calculation signal and a second active start calculation signal unless an active in regulation signal has been received during the first set point calculation operation, wherein an activated count signal causes the set point DAC up/down counter to increment or decrement.

7. The fluid ejection device of claim 6, wherein the set point controller inhibits the count signal from being activated once an active in regulation signal is received during the first set point calculation operation until the second active start calculation signal is received.

8. The fluid ejection device of claim 6 wherein the first set point calculation operation determines the lower set point offset voltage.

9. The fluid ejection device of claim 6 wherein the first set point calculation operation determines the upper set point offset voltage.

10. A fluid ejection device comprising:

an internal power supply path;

a power regulator providing an offset voltage from the internal power supply path voltage, the power regulator including a self-calibration circuit adapted to determine a regulation band of the power regulator defined by a lower set point offset voltage and an upper set point offset voltage, wherein the power regulator includes:

a digital-to-analog converter (DAC) coupled to the internal power supply path and configured to receive a digital offset command representing a desired offset voltage and to provide an analog offset voltage from the internal power supply path voltage;

a group of nozzles;

a corresponding group of firing resistors; and a corresponding group of switches controllable to couple a selected firing resistor of the group of firing resistors between the internal power supply path and the offset voltage to thereby permit electrical current to pass through the selected firing resistor to cause a corresponding selected nozzle to fire;

wherein the self-calibration circuit includes a set point DAC up/down counter storing a set point offset voltage digital value which is provided as the digital offset command; and wherein the set point DAC up/down counter receives a load signal and data lines, wherein a preset set point offset voltage digital value is loaded into the set point DAC up/down counter via the data lines in response to an active load signal.

11. The fluid ejection device of claim 10 wherein the set point DAC up/down counter receives a count signal which when activated causes set point DAC up/down counter to increment or decrement the set point offset voltage digital value.

12. The fluid ejection device of claim 11 wherein the set point DAC up/down counter receives an up/down signal which determines whether the set point DAC up/down counter increments or decrements the set point offset voltage digital value.

13. The fluid ejection device of claim 10 herein the set point DAC up/down counter receives a read signal and is responsive to an active read signal to provide the set point offset voltage digital value on the data lines.

14. A fluid ejection assembly comprising:

at least one fluid ejection device, each fluid ejection device including:

an internal power supply path;

a power regulator providing an offset voltage from the internal power supply path voltage, the power regulator including a self-calibration circuit adapted to determine a regulation band of the power regulator defined by a lower set point offset voltage and an upper set point offset voltage, wherein the power regulator includes:

a digital-to-analog converter (DAC) coupled to the internal power supply path and configured to receive a digital offset command representing a desired offset voltage and to provide an analog offset voltage from the internal power supply path voltage; and a feedback amplifier having a first input coupled to the analog offset voltage, a second input coupled to a feedback line, and an output coupled to a drive line;

a group of nozzles;

a corresponding group of firing resistors; and a corresponding group of switches controllable to couple a selected firing resistor of the group of firing resistors between the internal power supply path and the offset voltage to thereby permit electrical current to pass through the selected firing resistor to cause a corresponding selected nozzle to fire;

wherein a selected switch corresponding to a selected firing resistor has a control gate controlled by the drive line; and wherein the selected firing resistor of the group of firing resistors includes a first terminal and a second terminal coupled to the feedback line, wherein the drive line provides the offset voltage to the feedback line and the second terminal of the selected firing resistor through the selected switch.

15. The fluid ejection assembly of claim 14 wherein the at least one fluid ejection device includes multiple fluid ejection devices.

16. A method of self-calibrating power delivery control to firing resistors in an fluid ejection device comprising:

coupling a selected firing resistor of a group of firing resistors between an internal power supply path and an offset voltage from the internal power supply path voltage to cause electrical current to pass through the selected firing resistor to cause a corresponding selected nozzle to fire, wherein the offset voltage is provided by:

providing a digital offset command representing a desired offset voltage;

converting the digital offset command to an analog offset voltage from the internal power supply path voltage; and determining a power regulation band defined by a lower set point offset voltage and an upper set point offset voltage;

wherein determining the power regulation band further comprises:

storing a set point offset voltage digital value;

providing the set point offset voltage digital value as the digital offset command;

providing a fire pulse;

providing a start calculation signal;

providing an in regulation signal which is activated based on being in the power regulation band;

activating a count signal at every fire pulse in a first set point calculation operation occurring between a first active start calculation signal and a second active start calculation signal unless an active in regulation signal has been provided during the first set point calculation operation; and incrementing or decrementing the set point offset voltage digital value in response to every activated count signal in the first set point calculation operation.

17. The method of claim 16 wherein determining the power regulation band further comprises:

providing an in regulation signal which is activated based on being in the power regulation band.

18. The method of claim 16 further comprising:

reading the set point offset voltage digital value.

19. A self-calibrating power regulator in an fluid ejection device comprising:

a power delivery control loop providing an offset voltage from an internal power supply path voltage, wherein a selected firing resistor in the fluid ejection device is coupled between the internal power supply path and the offset voltage to cause electrical current to pass through the selected firing resistor to cause a corresponding selected nozzle to fire; and a self-calibration circuit adapted to determine a regulation band of the power regulator defined by a lower set point offset voltage and an upper set point offset voltage; the self-calibration circuit including:

a set point up/down counter storing a set point offset voltage digital value representing a desired offset voltage, wherein the power delivery control loop is responsive to the offset voltage digital value to provide the offset voltage; and a set point controller receiving a fire pulse, a start calculation signal, and an in regulation signal which is activated based on the power regulator being in regulation, the set point controller activating a count signal to the set point up/down counter at every received fire pulse in a first set point calculation operation occurring between a first active start calculation signal and a second active stall calculation signal unless an active in regulation signal has been received during the first set point calculation operation, wherein an activated count signal causes the set point up/down counter to increment or decrement.

* * * * *